United States Patent [19]

Hipkins, Sr.

[11] Patent Number: 5,052,861

[45] Date of Patent: Oct. 1, 1991

[54] ROOF BOLT WITH PLASTIC SLEEVE AND MECHANICAL ANCHOR

[75] Inventor: Edward C. Hipkins, Sr., Oakdale, Pa.

[73] Assignee: H&S Machine & Supply Co., Inc., Coraopolis, Pa.

[21] Appl. No.: 509,481

[22] Filed: Apr. 16, 1990

[51] Int. Cl.[5] ..... E21D 20/02

[52] U.S. Cl. ..... 405/261; 405/260; 411/32; 411/42

[58] Field of Search ..... 405/261, 260; 411/32, 411/34, 42, 35–38

[56] References Cited

U.S. PATENT DOCUMENTS

| | | | |
|---|---|---|---|
| 2,765,834 | 10/1956 | Poupitch | 411/82 X |
| 2,952,129 | 9/1960 | Dempsey | 61/45 |
| 4,100,748 | 7/1978 | Hansen | 61/45 |
| 4,193,715 | 3/1980 | Vass | 405/261 |
| 4,194,858 | 3/1980 | Evans | 405/259 |
| 4,275,975 | 6/1981 | Morgan | 405/261 |
| 4,483,645 | 11/1984 | White et al. | 405/261 |
| 4,556,344 | 12/1985 | White | 405/261 |
| 4,601,614 | 7/1986 | Lane et al. | 405/261 |
| 4,655,645 | 4/1987 | Hipkins, Sr. et al. | 405/261 |
| 4,664,561 | 5/1987 | Frease | 405/261 |
| 4,690,597 | 9/1987 | Liebig | 411/32 |
| 4,861,198 | 8/1989 | Stankus | 405/261 |
| 4,865,489 | 9/1989 | Stankus et al. | 411/82 X |

*Primary Examiner*—Dennis L. Taylor

*Attorney, Agent, or Firm*—Webb, Burden, Zeisenheim & Webb

[57] ABSTRACT

A mine roof anchor assembly usable with a quick-setting resin cartridge inserted into a mine roof opening is disclosed and includes a partially threaded elongated bolt having a first end, a mechanical anchor, such as a bail-type or mechanical expansion type, at a threaded end, and a mixing element, such as a coil, having an upper end attached to the bolt and positioned external of and surrounding a length along the bolt. The bolt receives a frangible hollow plastic sleeve which is positioned about the threaded portion and extends below the mechanical anchor toward the bolt head. A stopping element attaches to the bolt below the mechanical anchor toward the first end, whereby the frangible sleeve is sandwiched between the stopping element and the mechanical anchor. A shaft can also be coupled to the first end extending the length of the anchor assembly.

28 Claims, 3 Drawing Sheets

ROOF BOLT WITH PLASTIC SLEEVE AND MECHANICAL ANCHOR

BACKGROUND OF THE INVENTION

1. Field of the Invention

This invention relates to roof bolts and, more particularly, to a roof bolt which is positioned in a bore hole drilled in a rock formation in a mine roof and which is held in place within the bore by both a mechanical anchor and a quick-setting resin.

2. Description of the Prior Art

It is a well-established practice in underground mining work, such as coal mining, tunnel excavation or the like, to reinforce or support the mine roof to prevent rock falls or cave-ins. A common means presently used to support mine roofs is an elongated bar which is inserted into the rock formation above the mine roof in a bore hole and which is securely fixed to the bore hole by an anchoring means such as a mechanical ânchor, a quick-setting resin which surrounds the end of the bolt within the hole, or both. The roof bolt, placed under the tension, is used to hold a metal support plate in close engagement with the roof.

The roof bolt described in U.S. Pat. No. 4,655,645 combines the features of a mechanical anchor and resin bonding but also provides positive and complete mixing of the resin components by an additional mixing mechanism. This arrangement is relatively inexpensive and easy to manufacture, forces the resin upwards along the bolt during mixing, more violently mixes the resin for a shorter mix time, and eliminates the use of a two-position coupling or delay mechanism. While this arrangement functions well in hard rock-like formations, it has been found to be less effective in soft strata. Further, at times even this type of mine roof bolt does not properly set in the rock formation because of slippage of the bolt. This problem increases as a function of increased bore hole diameter since the volume of the annulus between the roof bolt and bore hole wall increases accordingly because, I believe, of greasing the interface between the mechanical anchor and bore hole wall.

A bail-type mechanical anchor, such as disclosed in U.S. Pat. Nos. 2,952,129; 4,483,645; 4,100,748; and 4,861,148 is typically used in the soft type strata are used. However, when the bail-type anchor is used in conjunction with a quick setting resin a phenomenon called lockup often occurs. Specifically, lockup occurs when the mine roof bolt is placed in a mine roof bore and rotated, generally by a bolting machine, and at a certain point the tension does not increase for a given increase of torque applied to the bolt. Further, after the bolting machine is removed the bolt tends to spring back or rotate in an opposite direction. I believe this is caused by the resin greasing the interface between the mechanical anchor and the mine roof bore wall. This allows the leaves or radially outwardly expandable sections of the shell to slide down the bore hole with the threaded plug or wedge as the bolt is rotated until the plug or wedge reach a non-threaded portion of the roof bolt or a stopping mechanism such as a jam nut. Thus, the result is a less than satisfactory arrangement since the mine roof may not be properly supported by the roof bolts because of the lockup condition.

It is an object of the present invention to provide a roof bolt arrangement that has a mechanical anchor, yet does not exhibit lockup when used in conjunction with a quick-setting resin.

It is a further object of the present invention to provide a roof bolt arrangement requiring less resin than is presently being used in resined mine roof anchor assemblies.

It is still a further object of the present invention to provide an improved roof bolt that can be used with or without resin.

SUMMARY OF THE INVENTION

One embodiment of my invention is a mine roof anchor assembly including an elongated bolt having a first end and a second end where the bolt is threaded for a portion of its length at the second end. The threaded portion of the bolt carries a mechanical anchor which includes an expansion member having radially outwardly expandable sections and a wedge member threadedly engaged with the elongated bolt between the radially expandable sections. The wedge forces the radially expandable sections outwardly with respect to the longitudinal movement thereof as the bolt is rotated. A section of the threaded portion extends below the mechanical anchor toward the first end. The bolt receives a frangible hollow sleeve which is positioned about the threaded portion extending below the mechanical anchor toward the first end. The frangible sleeve can be a shell made of plastic, such as polyurethane, and have a thickness of 0.075 inches.

The anchor bolt assembly can further include a stopping element, such as a jam nut, attached to the bolt below the mechanical anchor toward the first end. The frangible sleeve is sandwiched between the stopping element and the mechanical anchor. The stopping element can include a plurality of axial passages whereby a resin can pass from the second end of the bolt downwardly towards the first end of the bolt.

When the anchor bolt assembly is used with a quick-setting resin cartridge inserted in a mine roof opening, the stopping element can also include a resin mixing element, such as a coil, attached to the bolt and positioned below the stopping element toward the first end.

The anchor assembly can also include an elongated bolt having a head at one end and threaded for a portion of its length at its other end. A bail-type mechanical anchor is carried at the threaded end. The bail-type mechanical anchor includes an expansion member and a wedge member. The expansion member has diametrically opposed parts and a connecting member having spaced legs and a base. Lower ends of each of the legs are connected to a respective upper portion of an opposed part. The base is joined to the upper ends of the legs. The wedge member is threadedly engaged with the elongated bolt between the legs of the connecting member and the opposed parts of the expansion member. The wedge will force the opposed parts outwardly with respect to longitudinal movement thereof as the bolt is rotated.

Another embodiment of my invention includes an elongated bolt having a head at one end and threaded for a portion of its length at the other end, a mechanical expansion anchor including a spreader on the threaded end with a section of the threaded portion extending below the mechanical expansion anchor, and a frangible hollow sleeve received by the bolt and positioned about the threaded portion extending below the mechanical expansion anchor toward the head. This embodiment further includes a frangible support element attached to the bolt and sandwiched between the frangible sleeve and the mechanical expansion anchor, and a stopping element attached below the mechanical anchor toward the head, where the frangible sleeve is sandwiched between the stopping element and the frangible support element.

A further embodiment of my invention includes an elongated shaft having a first end and a shaft second end, and a bail-type anchor on the threaded second end of the shaft, with a section of the threads extending below the bail-type mechanical anchor toward the first end. A frangible hollow sleeve is received by the shaft and positioned about the threaded section extending below the bail-type anchor toward the first end. A stopping element is attached to or is formed on the shaft below the bail-type mechanical anchor toward the first end, with the frangible sleeve sandwiched between the stopping element and the mechanical anchor. A coupling is attached to the shaft first end and a shaft having a head at one end is attached to the coupling at its other end.

DETAILED DESCRIPTION OF THE PREFERRED EMBODIMENT

Figure 1:
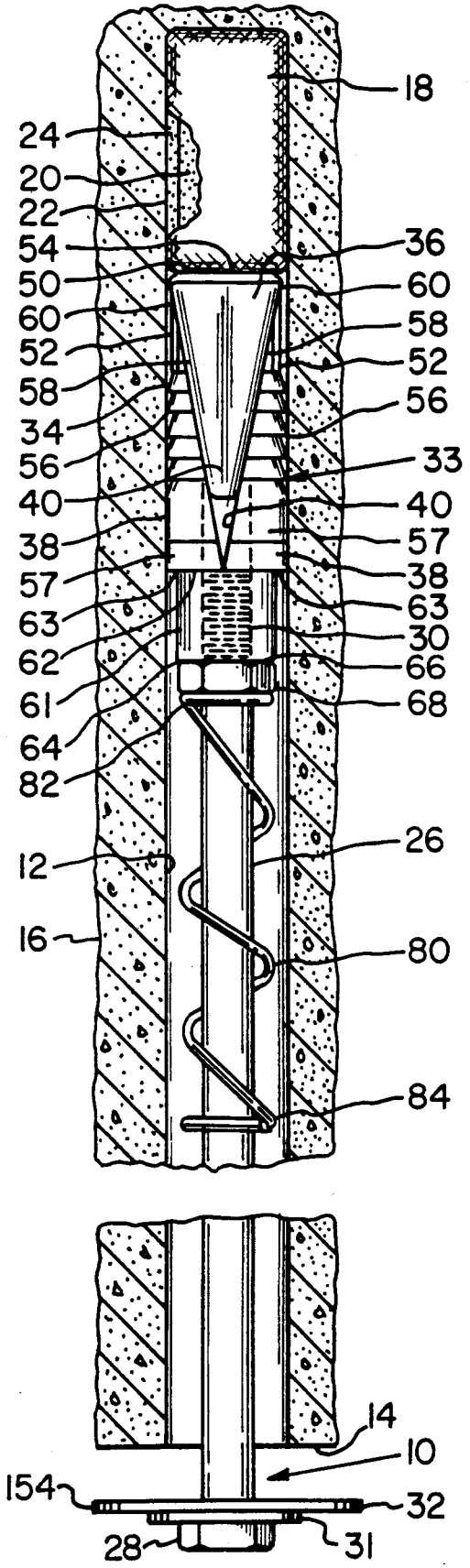
FIG. 1 is a side elevational view, partially in section, showing a rock formation having a bore hole with a first embodiment of a roof bolt assembly in accordance with the present invention in place just prior to rupture of a resin cartridge.
Figure 2:
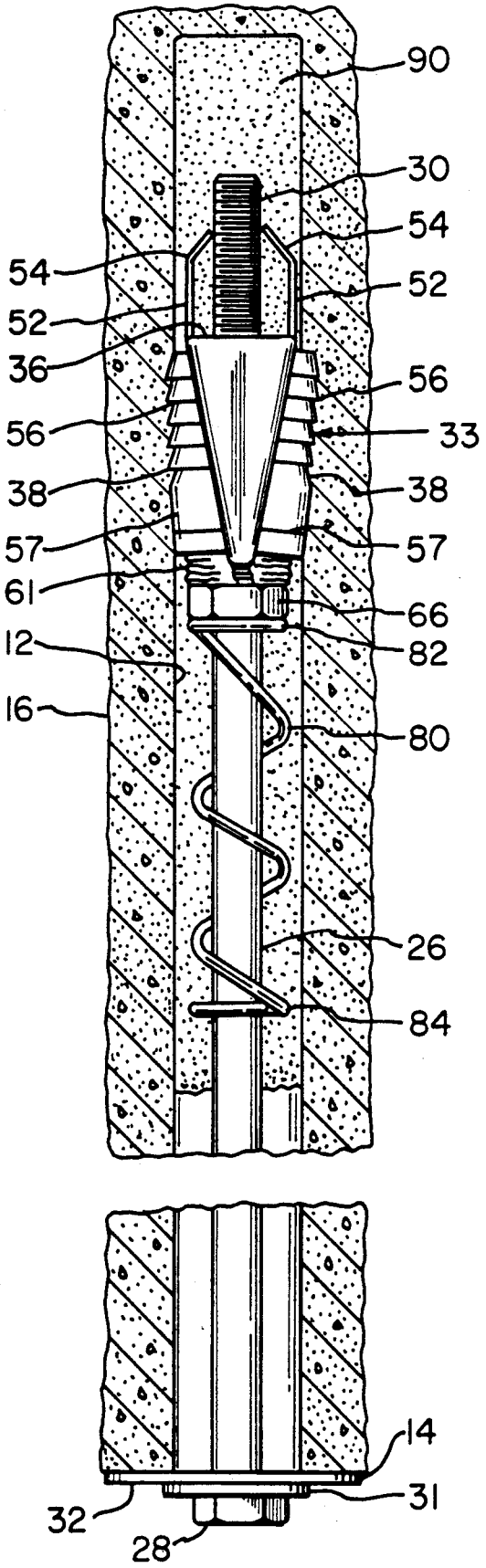
FIG. 2 is a side elevational view similar to FIG. 1 showing the roof bolt assembly as it is finally installed in the bore hole.

Referring now to FIGS. 1 and 2, there is shown a first embodiment of a roof bolt assembly, generally designated 10, in accordance with the present invention. The roof bolt 10 is an elongated member often reaching lengths of three to eight feet or longer. The roof bolt 10 is positioned within a bore hole 12 which is drilled upwardly through a generally horizontal mine roof surface 14 and into the rock formation 16 above the mine entry.

A quick-setting resin cartridge 18 is positioned in the blind or upward end of the bore hole 12. The resin cartridge 18 is basically an enclosed, elongated tube which includes two components, an active agent 20 and a reaction agent 22 of a resin grouting mix, separated by a membrane 24. The active agent of a commonly available resin cartridge includes a polyester resin as the major component. The reaction agent is typically a catalyst or curing or hardening agent. The two components 20, 22 of the resin cartridge 18 remain in a semi-liquid or thixotropic phase until mixed, whereupon the resin begins to quickly solidify. Curing and solidification continue until an extremely strong bond is formed by the resin grout. While reference has been made to a "resin" cartridge, it is to be understood that any of the resin systems, adhesive systems, cementitious systems, grouting systems, and the like which are known and used in the art can be used in the present invention, and are meant to be encompassed by the term "resin". However, polyester or other resin cartridges are preferred for use with the roof bolt assembly 10.

The roof bolt assembly 10 includes an elongated bolt shaft 26 with a head 28 on a first end and with threads 30 at a second end. The head 28 of a mine roof bolt can be any shape, but is typically square. A two-faced friction reducing washer 31, such as a hardened steel washer, is positioned immediately above and rests upon the head 28.

A bail-type mechanical anchor 33 is carried on the threaded end 30 of the bolt shaft 26. The bail-type mechanical anchor 33 includes a two-part expansible anchoring shell 34 and a wedged-shaped nut 36. The shell 34, which normally is generally circular in transverse section and of a diameter only slightly less than that of the bore hole 12, has two diametrically-opposed parts or radially outwardly expansible sections 38. Each part 38 is formed as a longitudinal segment of a cylinder and has upwardly divergent tapering longitudinal plane edges 40.

The smaller upper ends of the two parts 38 of the shell 34 are connected together by a band-like connecting member 50 that is substantially U-shaped. The connecting member 50 has two legs 52, which are normally generally parallel to each other and extend longitudinally of the shell 34, and a base 54, which extends transversely of the shell 34 somewhat above the upper ends of the two shell parts 38. The legs 52 of the connecting member 50 may be secured to the shell parts 38 in any appropriate manner, but preferably they should be pinned and crimped as is well known in the art. The curved outer surfaces of the shell parts 38 are preferably provided with a plurality of steplike circumferential serrations 56 for embedding and gripping engagement with the side walls of the bore hole 12. Vertical serrations 57 are provided on the curved outer surfaces of the shell parts 38 below the serrations 56. The wedge 36 is threaded on the threads 30 of the bolt shaft 26 and is disposed between the two shell parts 38 and has plane wedging surfaces 58 complementary to and in mutually-wedging engagement with each pair of the opposed side plane edges 40 of the shell parts 38. The exterior surfaces of the wedge 36 between its wedging surfaces 58 are arcuate to correspond to the circular periphery of the shell 34. At its larger end, the wedge 36 has longitudinal channels or grooves 60 to accommodate the legs 52 of the connecting member 50 passing thereby.

A plastic sleeve 61 in the shape of a hollow cylindrical shell is received by the bolt and positioned about a threaded portion of the threaded end extending below the mechanical anchor toward the head 28. The outer diameter of the sleeve 61 is slightly less than the outer diameter of the curved outer surfaces of the shell parts 38 so that a top edge 62 of the sleeve 61 can abut against bottom edges 63 of the shell parts 38. The diameter and length of the sleeve are substantially greater than the sleeve thickness, for example in a 10 to 1 ratio. A bottom edge 64 of the sleeve 60 abuts against a top surface 66 of a stopping element or jam nut 68 so that the sleeve 61 is sandwiched between the mechanical anchor 33 and the jam nut 68.

The jam nut 68, which is well known in the art, is a hexagonally shaped nut having a threaded bore and is threadably received by the threads 30. A jam nut bottom edge abuts against an interface formed between the threaded portion and unthreaded portion of the bolt shaft 26.

The roof bolt 10 further includes a separate mechanism connected thereto for mixing the two components 20, 22 of the resin cartridge 18 after it has been ruptured. Specifically, there is shown in FIGS. 1 and 2, one type of mixing element, namely a helical coil 80 which is separate from and surrounds the bolt shaft 26, and extends downward in the annulus between the rock formation 16 and the bolt shaft 26. An upper end 82 of the helical coil 80 is connected to the bottom of the threads 30. In the embodiment shown in FIG. 1, the upper end 82 of the helical coil 80 forms a loop which surrounds and is loosely crimped below the threads 30 below the jam nut 68. However, the coil upper end 82 may also be welded to the jam nut 68. A lower end 84 of the helical coil 80 may be affixed securely to bolt shaft 26 or may hang freely in the annulus between the rock formation 16 and the bolt shaft 26. It should be noted that the jam nut 68 may be eliminated and the stopping element for the sleeve 61 can be the upper end 82 of the coil 80.

The operation of roof bolt assembly 10 in accordance with the present invention can be explained with reference to the figures. Initially a resin cartridge 18 is placed in the bore hole 12 above the roof bolt 10 and then the roof bolt 10 is advanced upwardly into the bore hole 12. FIG. 1 shows the arrangement just prior to the rupture of the resin cartridge 18. The roof bolt 10 then continues to advance into the bore hole 12 and ruptures the resin cartridge 18. At the same time, the components 20, 22 of the ruptured resin cartridge 18 are forced downward from the upward displacement of the anchor assembly.

The bolt head 28 and, hence, the entire bolt shaft 26, is rotated continuously in one direction and is drawn upward until the support plate 32 and the washer 31 are compressed between the mine roof surface 14 and the bolt head 28. Continued rotation draws the bail-type anchor 33 downward against the abutting sleeve 61 and forces the opposed parts radially outward into an initial engagement with the bore hole wall and causes an upper end of the bolt shaft 26 to come into contact with the base 54 of the connecting member 50. The sleeve 61 prevents slippage which would otherwise occur because of the initial lubricating effect of the resin about the bore hole. Thereafter, the wedge 36 is further drawn down, independent of the expansion shell 34, and continues to force the shell parts 38 outwardly into engagement with the bore hole wall and cause the sleeve 61 to fail by crushing at a first breaking point force. Further rotation causes the connecting member 50 to subsequently break as shown in FIG. 2. Rotation of the roof bolt 10 is continued until the proper tensioning force is reached. At times the wedge 36 will continue to travel down all the threaded portion as the bolt 10 is rotated and stop against the jam nut top surface 66. During engagement of the mechanical anchor with the bore hole wall, the jam nut 68 is stationary relative to the bolt shaft 26.

While the roof bolt 10 is being rotated, the helical coil 80 is simultaneously being rotated. The resin components 20, 22 were previously forced downwardly to the vicinity of the helical coil 80 when the bolt 10 was advanced upwardly, and the action of rotating the helical coil 80 violently mixes resin components 20, 22 together and continually urges or forces the resin components 20, 22 upwardly. It is thus insured that the resin components are thoroughly mixed together and completely fill the annulus surrounding the upper portion of the roof bolt 10. The final curing of the resin to its ultimate rigid condition occurs after the rotation of the bolt 10 has stopped. Ideally, a substantial portion of the helical coil 80 will be embedded in the resin, but the exact proportion so embedded will depend on the resin cartridge 18, the porosity of the surrounding rock formation 16 and the exact diameter of the bore hole 12 and the bore shaft 26. The configuration of the roof bolt 10 in place with the cured resin 90 surrounding is shown in FIG. 2.

Actual mine roof anchor systems have been made and installed in accordance with the above described embodiment. Specifically, these anchor systems included either 0.75" or 1.00" diameter bolts and polyurethane plastic sleeves. The sleeves were approximately 1.25"-1.50" n length, 1.125" in outside and a wall thickness of 0.075". None of the mine roof anchor systems tested experienced lock-up nor did any of the systems become spinners where the opposed parts do not engage in the roof bore wall.

Further, it is believed that the frangible sleeve can be used in connection with any type of mechanical anchor having radially outwardly expandable sections, such as for example the expansion shell gripping fingers disclosed in U.S. Pat. No. 4,655,645, where the frangible sleeve would be sandwiched between the bottom of the expansion shell and the upper end of the helical coil.

Figure 3:
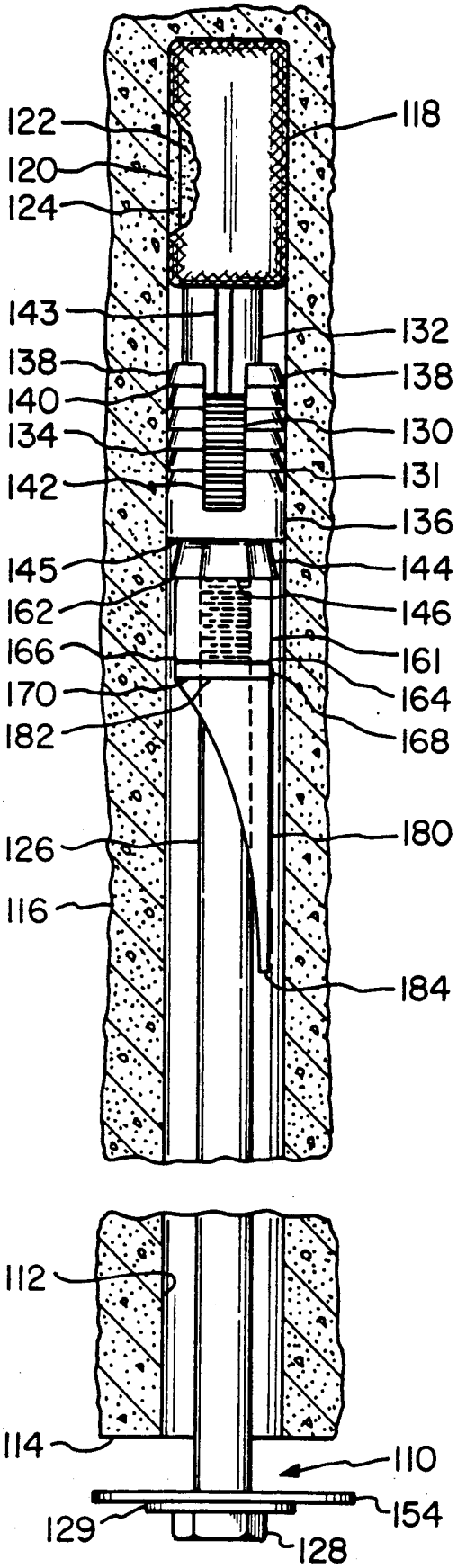
FIG. 3 is a side elevational view, partially in section, showing a rock formation having a bore hole with a second embodiment of a roof bolt assembly in accordance with the present invention in place just prior to rupture of a resin cartridge.
Figure 4:
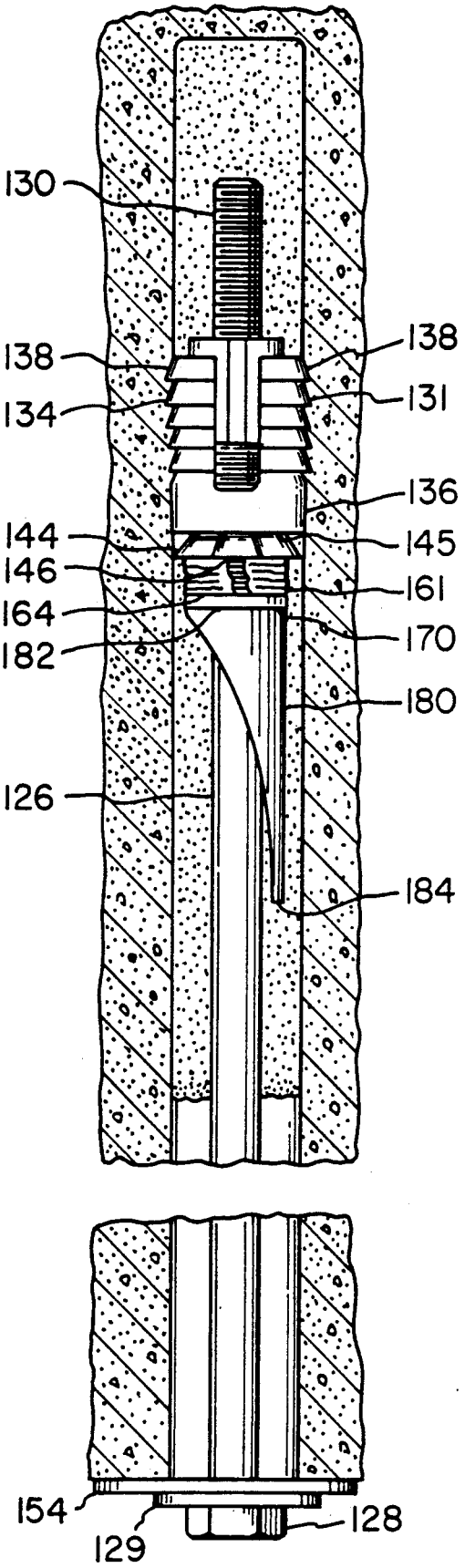
FIG. 4 is a side elevational view similar to FIG. 3 showing the second embodiment of the roof bolt assembly as it is finally installed in the bore hole.

Referring now to FIGS. 3-4 there is shown a second embodiment of a roof bolt assembly, generally designated 110, made in accordance with the present invention. The roof bolt 110 is an elongated member similar to roof bolt 10. The roof bolt !10 is positioned within a bore hole 112 which is drilled through a mine roof surface 114 and into the rock formation 116 above.the mine entry.

A quick-setting resin cartridge 118 which is similar to the resin cartridge 18, is positioned in the blind or upward end of the bore hole 112. The resin cartridge 118 is basically an enclosed, elongated tube which includes two components, an active agent 120 and a reaction agent 122 of a resin grouting mix, separated by a membrane 124.

The roof bolt assembly 110 includes an elongated bolt shaft 112 with a head 128 on one end and with threads 130 at the other end. A two-faced friction reducing washer 129, such as a hardened steel washer is positioned immediately above and rests on the head 128. An expansion anchor 131 comprising a tapered nut or spreader 132, having therein an internally threaded axial bore, and an expansion shell or gripping member 134, is carried on the threaded end 130 of the bolt shaft 126. The gripping member 134 is formed with a circular collar 136 at its base and with a plurality of radially expandable gripping fingers 138 extending integrally therefrom. Each gripping finger 138 is provided on its external surface with some type of gripping or engagement mechanism, such as the plurality of gripping teeth 140 as shown. The gripping fingers 138 are preferably spaced apart from one another by a narrow vertical slot 142. Further, the outer diameter of the gripping member 134 is greater than the diameter of the bore hole 112 so that the gripping member 134 can be held in place when it is positioned into the bore hole 112.

The spreader 132 has a downwardly tapered configuration with an enlarged upper end and a smaller lower end. A portion of the inner surface of each gripping finger 138 abuts the tapered outer surface of the spreader 132. An elongated key 143 on the outer surface of the spreader 132 and integral therewith is positioned within the vertical slot 142 between an adjacent pair of gripping fingers 138 and helps to keep the gripping member 134 from rotating along with the spreader 132 when the bolt shaft 126 is rotated.

A frangible first support 144, such as a hexagonal stamped support nut, is threadably received on the threaded end 130 of the bolt shaft 126 and is positioned directly beneath the circular collar 136 of the gripping member 134 with the gripping member 134 typically resting thereon. One stamped support nut which works well in this application is a Palnut® support nut. The stamped support nut 144 is preferably a stamped sheet metal nut and includes a first surface 145 having a bore therethrough that threadably receives the threaded bolt shaft 126 and upon when the circular collar 136 of the gripping member 134 rests, and six tabs 146 depending downwardly from the outer peripheral edge of the first surface 145.

A plastic sleeve 161 similar to the sleeve 61 in the shape of a hollow cylindrical shell is received by the bolt and positioned about a threaded portion of the threaded end extending below the mechanical anchor toward the head 128. The outer diameter of the sleeve 161 is slightly less than the outer diameter of the first support 144 so that a top edge 162 of the sleeve 161 rests against the underside of the first surface 145 of the first support 144 and the outer surface of the sleeve is surrounded by the tabs 146. A bottom edge 164 of the sleeve 161 abuts against a top surface 166 of a threaded stop 168.

The threaded stop 168 is a cylindrical ring having a threaded bore which is threadably received by the threads 130. A bottom edge 170 of the stop 168 abuts against an interface formed between the threaded portion and unthreaded portion of the bolt shaft 126.

The roof bolt further includes a mixing element 180 attached to the stop 168 for mixing the two components 120, 122 of the resin cartridge 118 after it has been ruptured. Specifically the mixing element 180 is an elongated element which extends downwardly toward the head 128 and is separate from the bolt shaft. A first end 182 of the mixing element 180 attached to a bottom surface of the stop 168 and a second end 184 hangs freely. The first end 182 is wider than the second end 184 and the outer surface of the mixing element 180 has a curved surface. Additionally, the mixing element 180 has sufficient thickness to form a step between the adjacent bolt shaft 126 outer surface and the mixing element outer surface to promote mixing of the resin cartridge components 120, 122.

The operation of the roof bolt assembly 110 is similar to that of the roof bolt assembly 10. Initially a resin cartridge 118 is placed in the bore hole 112 above the roof bolt 110 and the roof bolt 110 is advanced upwardly into the bore hole 112. FIG. 3 shows the arrangement just prior to the rupture of the resin cartridge 118. The roof bolt 110 then continues to advance into the bore hole 112 and ruptures the resin cartridge 118. At the same time, the components 120, 122 of the ruptured resin cartridge 118 are forced downward from the upward displacement of the anchor assembly.

The bolt head 128, and, hence, the entire bolt shaft 126, is rotated continuously in one direction and is drawn upward until a support plate 154 located immediately above the washer 131 and head 128 and in contact with the washer 131 comes into contact with the mine roof surface 114. Continued rotation draws the expansion anchor 131 and the stamped support nut 144 downward against the abutting sleeve 161 and then cause the spreader 132 to move downwardly along the threads 130. This downward movement of the spreader 132 causes the gripping fingers 138 to expand radially outward and force the gripping teeth 140 into a secure engagement with the rock formation 116 surrounding the bore hole 112 at which time the stamped support nut 144 and the sleeve 161 fail as shown in FIG. 4. The sleeve 161 prevents slippage which otherwise would occur because of the initial lubricating effect of the resin about the bore hole. During engagement of the mechanical anchor with the bore hole wall, the stop 168 is stationary relative to the bolt shaft.

Actual mine roof anchor systems including 0.750" and 1,000" diameter bolts have been made and installed having mixing element lengths of approximately 6" and having the plastic sleeve dimensions previously discussed. None of the mine roof anchor systems experienced lock-up nor did any of the systems become spinners.

Figure 5:
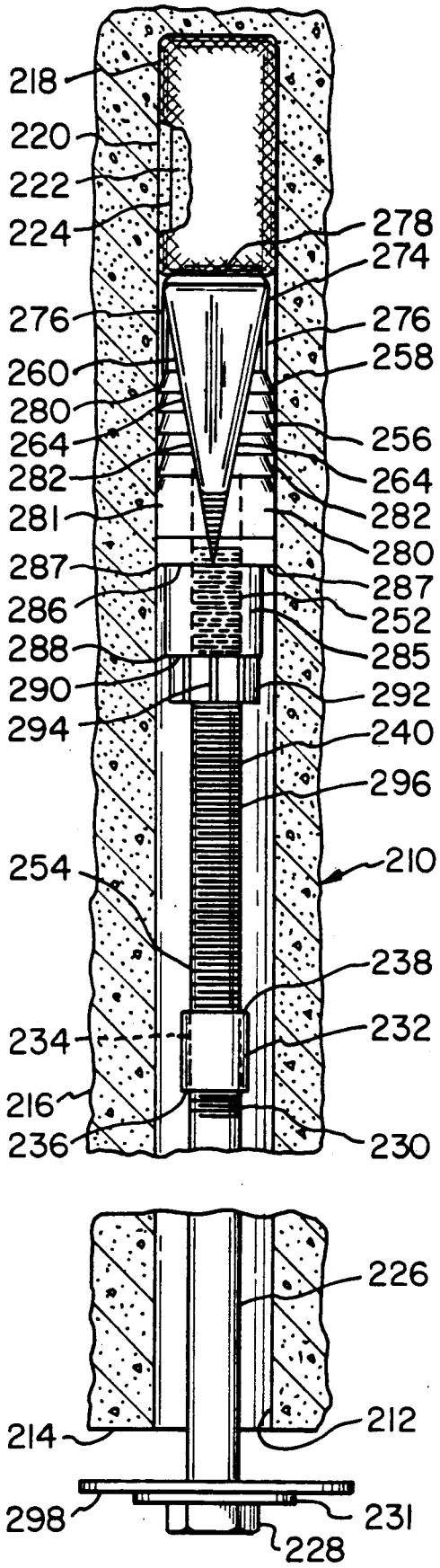
FIG. 5 is a side elevational view, partially in section, showing a rock formation having a bore hole with a third embodiment of a roof bolt assembly in accordance with the present invention in place just prior to rupture of a resin cartridge.
Figure 6:
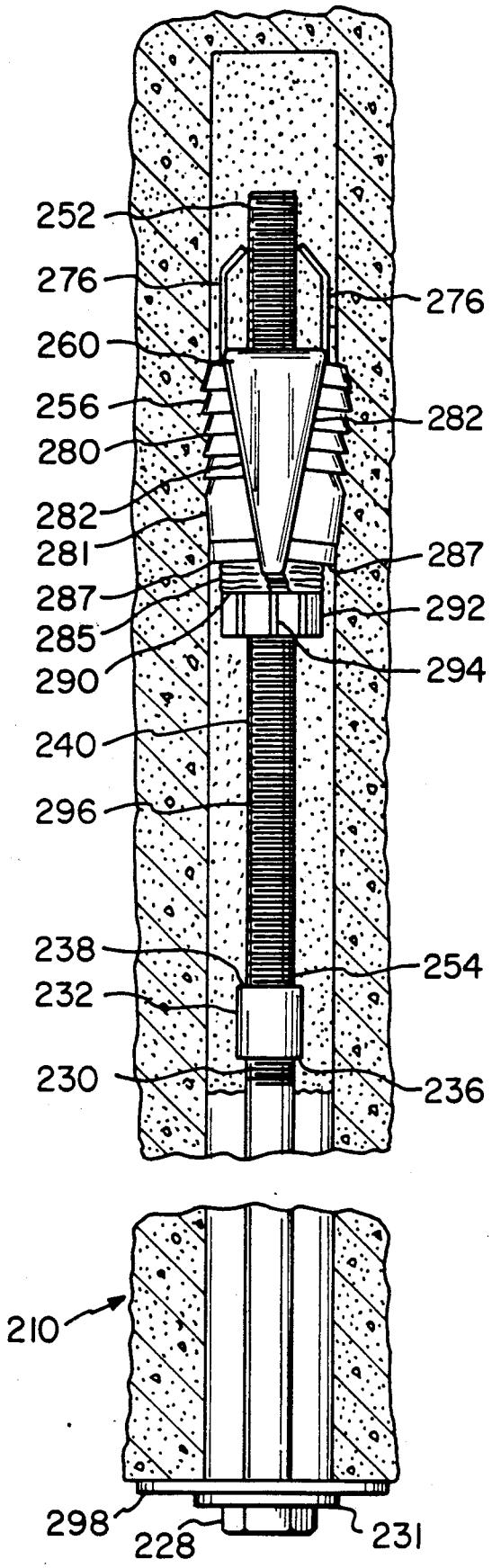
FIG. 6 is a side elevational view similar to FIG. 5 showing the third embodiment of the roof bolt assembly as it is finally installed in the bore hole.

Referring now to FIGS. 5 and 6 there is shown a third embodiment of a roof bolt assembly in accordance with my invention, generally designated 210. The roof bolt 210 is a multi-sectioned elongated member often reaching lengths of three to eight feet or longer. The roof bolt 210 is positioned within a bore hole 212 which is drilled upwardly through a generally horizontal mine roof surface 214 and into the rock formation 216 above the mine entry.

A quick-setting resin cartridge 218 is positioned in the blind or upward end of the bore hole 212. The resin cartridge 218 is basically an enclosed, elongated tube which includes two components, an active agent 220 and a reaction agent 222 of a resin grouting mix, separated by a membrane 224.

The roof bolt assembly 210 includes an elongated bolt shaft 226 with a head 228 on a first end and with threads 230 at a second end. A two-faced friction reducing washer, 231, such as a hardened steel washer, is positioned immediately above and rests upon the head 228. A cylindrical shaped coupling 232 having a threaded bore 234 is threadably received by the threads 230 at a first end 236 of the coupling 232. A second end of 238 of the coupling 232 receives a second shaft 240. Specifically, the second bolt shaft includes a first threaded end 242, threadably received by said second end 238 of said coupling 232, and a second threaded end 254.

A bail-type mechanical anchor 256 is carried on the second threaded end 254 of the shaft 240. The bail-type mechanical anchor 256 includes a two-part expansible anchoring shell 258 and a wedged-shaped nut 260. The shell 258, which normally is generally circular in transverse section and of a diameter only slightly less than that of the bore hole 212, has two diametrically-opposed parts or radially outwardly expansible sections 262. Each part 262 is formed as a longitudinal segment of a cylinder and has upwardly divergent tapering longitudinal plane edges 264.

The smaller upper ends of the two parts 262 of the shell 258 are connected together by a band-like connecting member 274 that is substantially U-shaped. The connecting member 274 has two legs 276, which are normally generally parallel to each other and extend longitudinally of the shell 258, and a base 278, which extends transversely of the shell 258 somewhat above the upper ends of the two shell parts 262. The legs 276 of the connecting member 274 may be secured to the shell parts 262 in any appropriate manner, but preferably they should be pinned and crimped as is well known in the art. The curved outer surfaces of the shell parts 262 preferably are provided with a plurality of step-like circumferential serrations 280 for embedding and gripping engagement with the side walls of the bore hole 212. Vertical serrations 281 are provided on the curved outer surfaces of the shell parts 262 below the serrations 280. The wedge 260 is threaded on the threads 254 of the second shaft 250 and is disposed between the two shell parts 262 and has plane wedging surfaces 282 complementary to and in mutually-wedging engagement with each pair of the opposed side plane edges 264 of the shell parts 262. The exterior surfaces of the wedge 260 between its wedging surfaces 282 are arcuate to correspond to the circular periphery of the shell 258. At its larger end, the wedge 260 has longitudinal channels or grooves 284 to accommodate the legs 276 of the connecting member 274 passing thereby.

A plastic sleeve 285 in the shape of a hollow cylindrical shell, similar to sleeve 61, is received by the shaft 240 positioned about a threaded portion of the threaded end extending below the mechanical anchor toward the head 228. The outer diameter of the sleeve 285 is slightly less than the outer diameter of the curved outer surfaces of the shell parts 262 so that a top edge 286 of the sleeve 285 can abut against bottom edges 287 of the shell parts 262. A bottom edge 288 of the sleeve 285 abuts against a top surface 290 of a cylindrical stopping element 292 which has an outer diameter greater than that of the sleeve 285 so that the sleeve 285 is sandwiched between the bail-type anchor 256 and the stopping element 292.

The stopping element 292 is integral with the shaft 240 and can be formed by impact forging shaft 240. A plurality of axial grooves or passages 294 are positioned about the circumferential surface of the stopping element 292. Grooves 294 permit resin to pass from an upper portion of the bolt shaft 240 containing the bail-type anchor 256 to a lower portion of the bolt assembly toward the coupling 252. The stopping element 292 can be any shape and need not be integral with the shaft 240, for example it could be a threaded nut having a plurality of axial grooves about its outer surface to permit the resin to pass therethrough carried on a threaded portion of the bolt 240 below the sleeve 285.

The roof bolt further includes a threaded or knurled segment 296 below the stopping element. Segment 296 mixes the two components 220, 222 of the resin cartridge after it has been ruptured. This segment 296 can be an extension of the threads of the threaded first end 252 of the shaft 240. Further, if the stopping element 292 is threaded onto the shaft 240, the shaft 240 could then be completely threaded. Further a mixing element such as previously discussed herein could be used.

The operation of roof bolt assembly 210 in accordance with the present invention can be explained with reference to the FIGS. 5 and 6. Initially, a resin cartridge 218 is placed in the bore hole 212 above the roof bolt 210 and then the roof bolt 210 is advanced upwardly into the bore hole 212. FIG. 5 shows the arrangement just prior to rupture of the resin cartridge 218. The roof bolt 210 then continues to advance into the bore hole 212 and ruptures the resin cartridge 218. At the same time, the components 220, 222 of the ruptured resin cartridge 218 are forced downward from the upward displacement of the anchor assembly. Much of the components 220, 222 pass through the axial grooves 294 of the stopping element 292 into the lower portion of the bolt assembly.

The bolt head 228 and shafts 226 and 240 are rotated continuously in one direction and are drawn upward until a support plate 298 and the washer 231 are compressed between the mine roof surface 214 and the bolt head 228. Continued rotation draws the bail-type anchor 256 downward against the abutting sleeve 285 and forces the opposed parts radially outward into an initial engagement with the bore hole wall and causes an upper end of the bolt shaft 250 to come into contact with the base 278 of the connecting member 274. The sleeve 285 prevents slippage which would otherwise occur because of the initial lubricating effect of the resin about the bore hole. Thereafter, the wedge 260 is further drawn down, independent of the expansion shell 258, so as to continue to force the shell parts 262 outwardly into engagement with the bore hole wall and cause the sleeve 285 to fail by crushing. Further rotation causes the connecting member 274 to subsequently break as shown in FIG. 2. Rotation of the roof bolt 210 is continued until the proper tensioning force is reached. During engagement of the mechanical anchor with the bore hole wall, the stopping element 292 is stationary relative to the bolt shaft.

While the roof bolt 210 is being rotated, the segment 292 is simultaneously being rotated. The resin components 220, 222 were previously forced downwardly to the vicinity of the segment 292 through the stopping element grooves 294 when the bolt 210 was advanced upwardly, and the action of rotating the segment 292 violently mixes resin components 220, 222 together and, in the case of threads, continually urges or forces the resin components 220, 222 upwardly. It is thus insured that the resin components are thoroughly mixed together and completely fill the annulus surrounding the upper portion of the roof bolt 210. The final curing of the resin to its ultimate rigid condition occurs after the rotation of the bolt 210 has stopped.

Actual mine roof anchor systems for a 1.375" diameter hole have been made and installed including a 1.125" diameter stopping element, a 1.250" diameter coupling, a frangible sleeve as previously discussed, and a 1" diameter segment below the stopping element. Not only were there no spinners or lock-up experienced, but substantially less resin was required to maintain the mine roof anchor system in high tension.

The previously described anchor assemblies including the frangible sleeves need not be used with a resin system.

Having described presently the preferred embodiments of this invention, it is to be understood that it may be otherwise embodied within the scope of the following claims:

I claim:

1. A mine roof anchor assembly for insertion into a mine roof bore hole defined by a bore hole wall comprising:

(a) an elongated bolt having a first end with a second end, said first end having a head and said bolt threaded for a portion of its length at said second end;

(b) an expandable anchor capable of engaging with the mine roof hole wall, said anchor carried on the threaded portion of said bolt;

(c) a stopping element attached to said bolt below said mechanical anchor toward said first end, said stopping element stationary relative to said bolt during engagement of said anchor with the bore hole wall; and (d) a frangible hollow sleeve received by said bolt and positioned between said stopping element and said mechanical anchor, whereby during engagement of the anchor with the bore hole wall said sleeve is sandwiched between said anchor and said stop and then breaks.

2. The anchor bolt assembly of claim 1 wherein said frangible sleeve comprises plastic.

3. The anchor bolt assembly of claim 2 wherein said plastic frangible sleeve comprises polyurethane.

4. The anchor bolt assembly of claim 2 wherein said sleeve has a wall thickness of approximately 0.075 inches.

5. The anchor bolt assembly of claim 1 further comprising a frangible support element attached to said bolt and sandwiched between said frangible sleeve and said mechanical anchor.

6. The anchor bolt assembly of claim 5 wherein said frangible support element includes a first surface having a threaded bore therethrough threadably received by said threaded portion of said shaft and a plurality of tabs depending downwardly from an outer peripheral edge of said first surface whereby an upper end of said frangible sleeve rests against an underside of the first surface and surrounded by said tabs.

7. The anchor bolt assembly of claim 1 wherein said stopping element is threadably received on said threaded portion.

8. The anchor bolt assembly of claim 1 wherein said stopping element comprises a jam nut.

9. The anchor bolt assembly of claim 1 wherein said stopping element is integral with said bolt.

10. The anchor bolt assembly of claim 1 wherein said stopping element includes a plurality of axial passages whereby a resin can pass from said second end of said bolt downwardly towards said first end of said bolt.

11. The anchor bolt assembly of claim 10 wherein said axial passages are positioned about an outer surface of said stopping element.

12. The anchor bolt assembly of claim 1 wherein said mine roof anchor assembly is usable with a quick-setting resin cartridge for insertion in a mine roof opening and wherein said anchor bolt assembly further includes a mixing element for mixing resin attached to said bolt and positioned below said stopping element toward said first end.

13. The anchor bolt assembly of claim 12 wherein said mixing element is integral with said stopping element.

14. The anchor bolt assembly of claim 12 wherein said mixing element comprises an elongated helical coil having an upper end attached to said bolt and positioned external of and surrounding a substantial length along the bolt, and positioned below said mechanical anchor, said coil having a direction of coil so as to urge resin upwardly towards said threaded end while said wedge moves downwardly and while said bolt is rotated in one continuous direction to achieve mixing of the resin and to secure the mechanical anchor to the rock; and whereby the quick-setting cartridge is ruptured by said mechanical anchor when it is forced upwardly into the mine roof opening thereby permitting the resin to gravitate downwardly between said wall of the opening and said bolt.

15. The anchor bolt assembly of claim 14, wherein said helical coil is formed in the shape of a loop which surrounds and is crimped to said bolt at the base of said bolt threads.

16. The anchor bolt assembly of claim 1 further including a coupling attached to said first end of said bolt and a shaft having a head at one end and attached to said coupling at another end.

17. The anchor bolt assembly of claim 16 wherein said first end of said bolt is threaded and is threadably received by said coupling, and said other end of said shaft is threaded and is threadably received by said coupling.

18. The anchor bolt assembly of claim 1 wherein said mine roof anchor assembly is usable with a quick-setting resin cartridge for insertion in a mine roof opening and wherein said anchor bolt assembly further including a mixing element integral with said bolt and positioned below said stopping element toward said first end.

19. The anchor bolt assembly of claim 18 wherein said mixing element comprises a threaded portion extending below said stopping element.

20. The anchor bolt assembly of claim 18 wherein said mixing element comprises a knurled portion extending below said stopping element.

21. The anchor bolt of claim 18 wherein said stopping element is integral with said bolt.

22. The anchor bolt assembly of claim 1 wherein said sleeve is a shell.

23. A mine roof anchor assembly comprising:

(a) an elongated bolt having a head at one end and threaded for a portion of its length at the other end;

(b) a mechanical expansion anchor including a spreader on the threaded end, with a section of said threaded portion extending below said mechanical expansion anchor;

(c) a frangible hollow sleeve received by said bolt and positioned about said threaded portion extending below said mechanical expansion anchor toward said head; and (d) a frangible support element attached to said bolt sandwiched between said frangible sleeve and said mechanical expansion anchor; and (e) a stopping element attached to said bolt below said mechanical anchor toward said head, said stopping element stationary relative to said bolt during engagement of said anchor with the bore hole wall whereby during engagement of the anchor with the bore hole wall said frangible sleeve is sandwiched between said stopping element and said frangible support element and then said sleeve breaks.

24. A mine roof anchor assembly comprising:

(a) an elongated shaft having a first end and threaded for a portion of its length at a second end;

(b) a bail-type mechanical anchor carried on said threaded end of said shaft, said anchor including an expansion member having diametrically opposed parts and a connecting member having spaced legs and a base, with lower ends of each of said legs being connected to a respective upper portion of said opposed parts, and with said base joining upper ends of said legs, and a wedge member threadedly engaged with said elongated bolt between said legs of said connecting member and said opposed parts of said expansion member, whereby said wedge will force said opposed parts outwardly with respect to longitudinal movement thereof as said bolt is rotated, with a section of said threaded portion extending below said bail-type mechanical anchor toward said second end head;

(c) a frangible hollow sleeve received by said shaft and positioned about said threaded portion extending below said bail type mechanical anchor toward said first end;

(d) a stopping element attached to said bolt below said bail type mechanical anchor toward said first end, said stopping element stationary relative to said bolt during engagement of said anchor with the bore hole wall, whereby during engagement of the anchor with the bore hole wall said frangible sleeve is sandwiched between said stopping element and said mechanical anchor and said stop then breaks;

(e) a coupling attached to said shaft first end; and (f) a bolt shaft having a head at one end and attached to said coupling its other end.

25. The mine roof anchor assembly of claim 1 wherein said anchor comprises:

a bail-type mechanical anchor carried on said threaded end of said bolt, said bail anchor including an expansion member having diametrically opposed parts and a connecting member having spaced legs and a base, with lower ends of each of said legs being connected to a respective upper portion of said opposed parts, and with said base joining upper ends of said legs, and a wedge member threadedly engaged with said elongated bolt between said legs of said connecting member and said opposed parts of said expansion member, whereby said wedge will force said opposed parts outwardly with respect to longitudinal movement thereof as said bolt is rotated, with a section of said threaded portion extending below said bail-type mechanical anchor toward said head.

26. The mine roof anchor assembly of claim 1 wherein said anchor comprises:

a mechanical anchor carried on said threaded portion of said bolt, said mechanical anchor including an expansion member having radially expandable sections and a wedge member threadedly engaged with said elongated bolt between said radially expandable sections, whereby said wedge will force said radially expandable sections outwardly with respect to longitudinal movement thereof as said bolt is rotated, and a section of said threaded portion extending below said mechanical anchor toward said first end.

27. A mine roof anchor assembly usable with a quick-setting resin cartridge for insertion in a mine roof opening comprising:

(a) an elongated bolt having a first end and a second end, said bolt threaded for a portion of its length at said second end;

(b) a mechanical anchor carried on said threaded portion of said bolt, said anchor including an expansion member having radially expandable sections and a wedge member threadedly engaged with said elongated bolt between said radially expandable sections, whereby said wedge will force said radially expandable sections outwardly with respect to longitudinal movement thereof as said bolt is rotated, and a section of said threaded portion extending below said mechanical anchor toward said first end;

(c) a frangible hollow sleeve received by said bolt and positioned about said threaded portion extending below said mechanical anchor toward said first end;

(d) a stopping element attached to said bolt below said mechanical anchor toward said first end, whereby said frangible sleeve is sandwiched between said stopping element and said mechanical anchor; and (e) a mixing element for mixing resin attached to said bolt and positioned below said stopping element toward said first end, said mixing element comprises an elongated helical coil having an upper end attached to said bolt and positioned external of and surrounding a substantial length along the bolt, and positioned below said mechanical anchor, said coil having a direction of coil so as to urge resin upwardly towards said threaded end while said wedge moves downwardly and while said bolt is rotated in one continuous direction to achieve mixing of the resin and to secure the mechanical anchor to the rock; and whereby the quick-setting cartridge is ruptured by said mechanical anchor when it is forced upwardly into the mine roof opening thereby permitting the resin to gratitate downwardly between said wall of the opening and said bolt.

28. The anchor bolt assembly of claim 27 wherein said helical coil is formed in the shape of a loop which surrounds and is crimped to said bolt at the base of said bolt threads.

* * * * *